United States Patent [19]

Bessone et al.

[11] 4,284,925

[45] Aug. 18, 1981

[54] MULTIPLE LEVEL DIMMING CIRCUIT FOR FLUORESCENT LAMP

[75] Inventors: Carlo S. Bessone, Woburn; William J. Roche, Merrimac, both of Mass.

[73] Assignee: GTE Products Corporation, Stamford, Conn.

[21] Appl. No.: 104,996

[22] Filed: Dec. 18, 1979

[51] Int. Cl.[3] ..... H05B 41/40

[52] U.S. Cl. ..... 315/240; 315/53; 315/244; 315/245; 315/291; 315/DIG. 4

[58] Field of Search ..... 315/51–53, 315/57, 58, 62, 70, 227 R, 240, 245, 291, DIG. 4, 244, 309, 362

[56] References Cited

U.S. PATENT DOCUMENTS

| | | | |
|---|---|---|---|
| 3,323,013 | 5/1967 | Lord | 315/DIG. 4 |
| 4,082,981 | 4/1978 | Morton et al. | 315/309 X |
| 4,178,535 | 12/1979 | Miller | 315/53 |

FOREIGN PATENT DOCUMENTS

| | | | |
|---|---|---|---|
| 1225294 | 9/1966 | Fed. Rep. of Germany | 315/DIG. 4 |

*Primary Examiner*—Eugene R. LaRoche
*Attorney, Agent, or Firm*—Edward J. Coleman

[57] ABSTRACT

A dimming circuit for operating a fluorescent lamp in an incandescent-to-fluorescent adapter at two selectable current levels. The circuit includes a choke which is series connected between the center contact of a three-contact incandescent base and one of the lamp filament coils, and a capacitor connected between the ring contact and center contact of the base. A bleeder resistor of the PTC type is connected across the capacitor. For use with an incandescent lamp fixture having a four-position, three-way switch, the circuit further includes a current limiting discharge resistor connected in series with the capacitor.

11 Claims, 5 Drawing Figures

MULTIPLE LEVEL DIMMING CIRCUIT FOR FLUORESCENT LAMP

BACKGROUND OF THE INVENTION

This invention relates to circuits for operating fluorescent lamps and, more particularly, to an improved dimming circuit for fluorescent lamps.

With the growing need for saving energy in the home, the significantly greater efficiency of fluorescent lamps, in terms of lumens per watt, as compared to the more commonly used incandescent lamps has spurred engineering development of improved methods for placing fluorescent lamps into more wide-spread residential use. One approach toward accomplishing this end has been to search for improved retrofit systems for the existing incandescent lamp fixtures. More specifically, an object has been to provide an improved incandescent-to-fluorescent adapter having a simplified, lightweight and compact design of reduced cost. Typically, such an adapter has consisted of a ballast, a starter for preheat operation, a fluorescent lamp, and mounting and support hardward. The base of the adapter contains a standard screw-type base for mating with the receptacle of an incandescent fixture. In cases where it is desired to retrofit the standard three-way incandescent fixture having a four-position switch (off-low-medium-high) for operating two filament lamps, such as the 50-100-150 watt type, it is necessary to provide a multiple level dimming circuit for a fluorescent lamp. In the past, such retrofit systems were operated at different light output levels either by using two separate preheat circuits or by using a solid-state dimming ballast. The first method requires two chokes, two starters and two lamps. Such systems tend to be comparatively costly and can add too much weight to the top of the fixture, whereby some small fixtures could tip over. The second method, which uses a solid state ballast, is also quite costly, and semi-conductor component failures can be comparatively frequent. Also, many solid-state ballasts which operate at high frequencies produce RF interference.

SUMMARY OF THE INVENTION

Accordingly, it is an object of the present invention to provide an improved multiple level dimming circuit for use with a fluorescent lamp.

A further object is to provide a dimming circuit for fluorescent lamps which is comparatively simple, lightweight and inexpensive.

These and other objects, advantages, and features are attained in a circuit comprising inductive ballast means, such as a choke, having a first terminal adapted to be selectively connected to a supply source and a second terminal adapted to be connected to a fluorescent lamp. The circuit further includes a capacitor ballast means which is connected between the first terminal of the inductive ballast means and a third terminal of the circuit, which is adapted to be selectively connected to the supply source. Connected across the capacitor ballast means is a bleeder resistance means, which in one application may comprise a linear resistor, and in another application is preferably a positive-temperature-coefficient (PTC) resistor having a heat up time to switching of at least about five seconds. In another application of the circuit, it is desirable to have a current limiting discharge resistor connected in series with the capacitor ballast means. In operation, connection of the first terminal of the circuit to a voltage supply source, such as a standard 120 volt, 60 cycle line source, by means such as an incandescent lamp switch is operative to provide a first level of lamp current and corresponding light output, and connection of the third terminal of the circuit to the supply source is operative to provide a second level of lamp current and corresponding light output level.

In a preferred embodiment of the invention the circuit is useful for operating a preheat type fluorescent lamp having a starter connected across the lamp. The lamp and dimming circuit are included in an incandescent-to-fluorescent adapter having a screw-type base for mating with the incandescent receptacle. The base is a standard three-contact base comprising an outer screw shell as a fourth terminal connected to the common side of the voltage source, a ring contact as the third terminal, and a center contact as the first terminal. In this manner, in the event the adapter is used with a two-position type incandescent lamp fixture, the "on" position of the lamp switch will connect the voltage source directly to the choke ballast of the circuit to permit conventional operation of the fluorescent lamp at a selected light output level. Such a wiring arrangement of the dimming circuit, however, causes the capacitor branch of the circuit to be the first energized when the adapter is used in the intended application, namely, in an incandescent lamp fixture having a conventional four-position switch (off position and three energizing position contacts). If the bleeder resistance were a linear resistor in this case, hard lamp starting would be experienced due to insufficient preheat current when the power is connected to the first energizing position. This is overcome by replacing the linear bleeder resistor with a PTC resistor, whereby the initially low resistance of the PTC device effectively shorts out the capacitor ballast means upon energizing the circuit. After a short period of time the resistance of the PTC device increases due to resistance heating. As a result, once the lamp is started, the capacitor ballast means is effectively switched into the circuit to either increase or decrease the lamp current, depending upon the circuit values chosen, and provide the desired light output level. If the third terminal of the circuit were connected to the center contact and the first terminal were connected to the ring contact, and if the circuit values were selected such that the capacitor-choke series circuit provides a lower value of lamp current, use of the adapter with an on-off type fixture would result in only a lower light output being available. When this configuration is used with a conventional four-position switch, the voltage source will be directly connected to the choke ballast in the first energized position and provide the high light output level. The next energizing positions will connect the capacitor-choke series circuit to the voltage source to provide the lower light output level.

BRIEF DESCRIPTION OF THE DRAWINGS

This invention will be more fully described hereinafter in conjunction with the accompanying drawings, in which.

DESCRIPTION OF PREFERRED EMBODIMENTS

Figure 1:
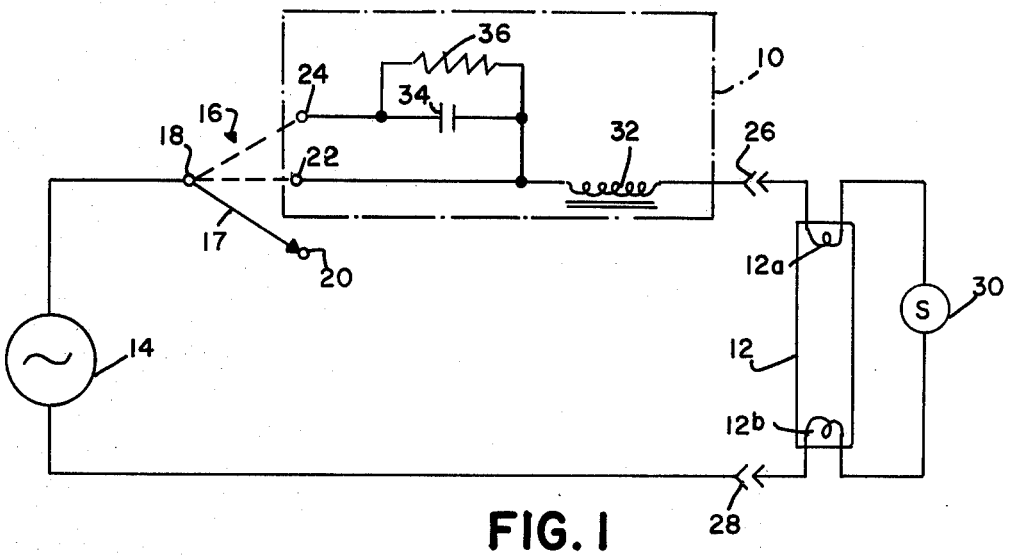
FIG. 1 is a schematic diagram of a dimming circuit according to the invention as used with a voltage source, three position switch, fluorescent lamp and starter.

Referring to FIG. 1, a dimming circuit 10 according to the invention is illustrated as used with a fluorescent lamp 12 operated from a voltage supply source 14. In the typical application, voltage supply 14 is a 120 volt, 60 cycle line source. Source 14 is shown connected to the dimming circuit by means of a three-position switch 16, such as a single-pole double-throw switch, having a common terminal 18 connected to one side of the supply source 14, an "off" position 20, a first energizing position contact 22 and a second energizing position contact 24. Lamp 12 has a pair of filament coils 12*a* and 12*b* which are connected to terminal interconnections 26 and 28, respectively. Typically, fluorescent lamp 12 is of the preheat type and therefore has a starter 30 connected across the lamp coils. It is to be understood, however, that dimming circuit 10 is not limited to use with preheat lamps but in certain applications may also be useful with rapid-start and instant-start types, for example. Terminal interconnection 28 is connected to the other, or common, side of the voltage source 14.

The basic dimming circuit itself comprises an inductive ballast means, such as the illustrated choke 32, connected between a first terminal, represented by switch contact 22, and a second terminal represented by the interconnection 26. Contact 22 is selectively connectable to the supply source by means of the switch 16, and interconnection 26 is adapted to be connected to coil 12*a* of the fluorescent lamp. The dimming circuit further includes a third terminal, represented by switch contact 24, and a capacitor ballast means, such as the illustrated capacitor 34, connected between contacts 22 and 24. Contact 24, of course, is also selectively connectable to the supply source 14. The dimming circuit is completed by a bleeder resistor 36 connected across capacitor 34.

For operation of the circuit, switch 16 includes a center arm 17 which is illustrated as in the "off" position 20 in FIG. 1. When the center arm is moved to the next contact position 22, choke 32 is connected in series between one side of the voltage source 14 and filament coil 12*a* of the lamp 12, whereupon the circuit is operative to provide a first level of lamp current and corresponding light output. To provide a second level of lamp current, and corresponding light output, center arm 17 is switched to contact 24, thereby placing the current-changing capacitor 34 in series with choke 32 of the energized circuit. Typically, the values of choke 32 and capacitor 34 are selected such that the net impedance of the LC combination is higher than the impedance of the choke alone; in such a case, energization of contact 22 provides a relatively higher level of lamp current and light output, and energization of contact 24 provides a relatively lower level of lamp current and light output. It is to be understood, however, that the values of the capacitor and choke can be selected to yield a reversed function, namely, a lower combined impedance and thus higher lamp current than is the case for the choke alone. Further, although two levels of lamp current and light output are indicated by the illustrated circuit, it is clear that by providing additional capacitor circuit branches of respectively different capacitance values, more than two levels of dimming may be provided.

The component values we have found to be particularly useful for such a circuit are a capacitance range of 2 to 8 microfarads for capacitor 34, a resistance value of 50 Kohms or greater for the bleeder resistance 36 (this is not critical), and an inductance of 380 millihenrys for choke 32.

Figure 2:
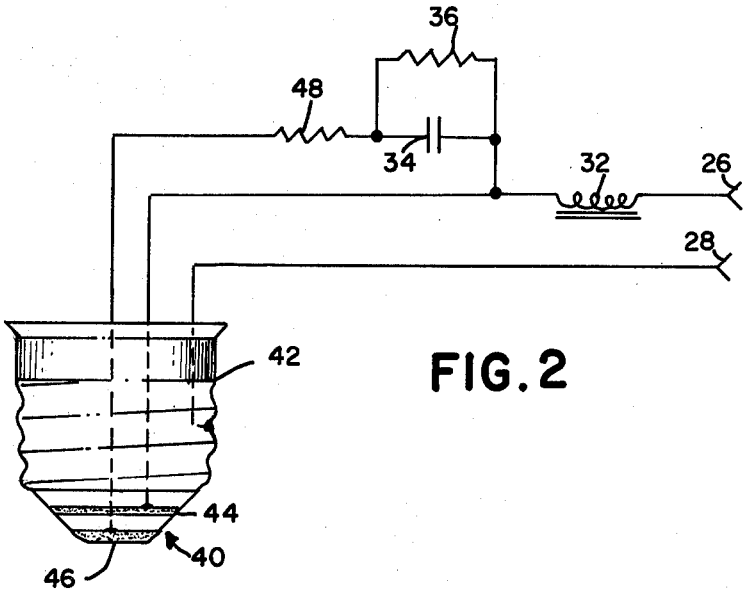
FIG. 2 is a schematic diagram of a dimming circuit according to the invention as connected in one manner to a three-contact screw-in base.

The dimming circuit of the invention is particularly useful when employed in an incandescent-to-fluorescent adapter having a three-contact screw-type base for mating with the receptacle of a typical three-way incandescent fixture. The diagram of FIG. 2 schematically illustrates such an adapter arrangement. Components corresponding to those of the circuit of FIG. 1 are denoted with the same identifying numerals. The lamp interconnect terminal 28 is shown connected to the outer screw shell 42 of the adapter base 40. The power source side of choke 32 is shown connected to the ring contact 44 of the adapter base, and the circuit branch including capacitor 34 is shown connected between the ring contact 44 and the center contact 46 of the adapter base. In this instance, however, the circuit further includes a current limiting discharge resistor 48 series connected between center contact 46 and capacitor 34. The function of resistor 48 will be described hereinafter.

Figure 3:
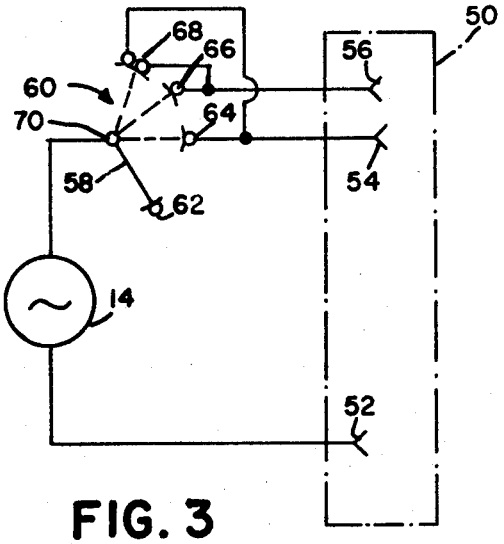
FIG. 3 is a circuit diagram of a three-way incandescent fixture showing a four-position switch.

To better illustrate the operation of the aforementioned circuit, FIG. 3 illustrates a schematic diagram of the voltage source and a three-way incandescent lamp fixture with which the adapter of FIG. 2 may be employed. The incandescent fixture includes a receptacle 50 having a contact area 52 connected to the common side of voltage source 14, a contact 54 connected to one contact position of a four-position switch 60, and a contact area 56 connected to another contact position of the switch 60. Upon engaging the base 40 into the receptacle 50, the receptacle contact areas 52,54 and 56 are respectively interconnected with the base contact areas 42, 44 and 46. Switch 60 is of the typical type employed for three-way incandescent lamps and includes an "off" position 62, a center arm 58 (illustrated in the "off" position), a first energizing position contact 64, a second energizing position contact 66, and a third energizing position contact arrangement 68, which actually comprises closely positioned terminals which when contacted by the center arm 58 connect the center arm to both of the energizing contacts 64 and 66. Center arm 58 is connected to a common switch terminal 70, which in turn is connected to the non-common side of voltage source 14.

In operation, once the arm 58 is moved to the next position contact, namely 64, the circuit including contact area 54, ring contact 44, choke 32, interconnect terminal 26, lamp 12, interconnect terminal 28, screw shell 42 and contact area 52 is connected across the voltage source 14 and energized thereby. In this instance, contact position 64 provides the high lamp current and high light output levels. Once the arm 58 is sequenced to the next energizing position contact, namely 66, the energized circuit branch comprises contact area 56, center contact 46, resistor 48, capacitor 34 and resistor 36 (in parallel), choke 32, interconnect terminal 26, lamp 12, interconnect terminal 28, shell 42 and contact area 52. With capacitor 34 functioning as a current reducing capacitor, switch contact 66 thereby provides lower lamp current and light output levels. Upon sequencing the center arm of switch 62 to the contact arrangement 68, both of the contact areas 54 and 56, and thus both the ring and base contact of the adapter base, are connected to the voltage source. With the contact arrangement 68 energized, therefore, capacitor 34 will discharge through resistor 48, and lamp current will flow through choke 32 and the lamp. Hence lamp current and light output will be equal to that obtained in contact position 64. Resistor 48 has a value of about 10 ohms and functions to limit the capacitor current discharging through contact positions 64 and 66 to a safe level. The resistance value of resistor 48 should not be so high as to dissipate too much power when the lamp is in the low position, yet the resistance value should be sufficiently high to prevent welding of the switch center arm 58 to the contact arrangement 68 when the capacitor is discharging.

Figure 4:
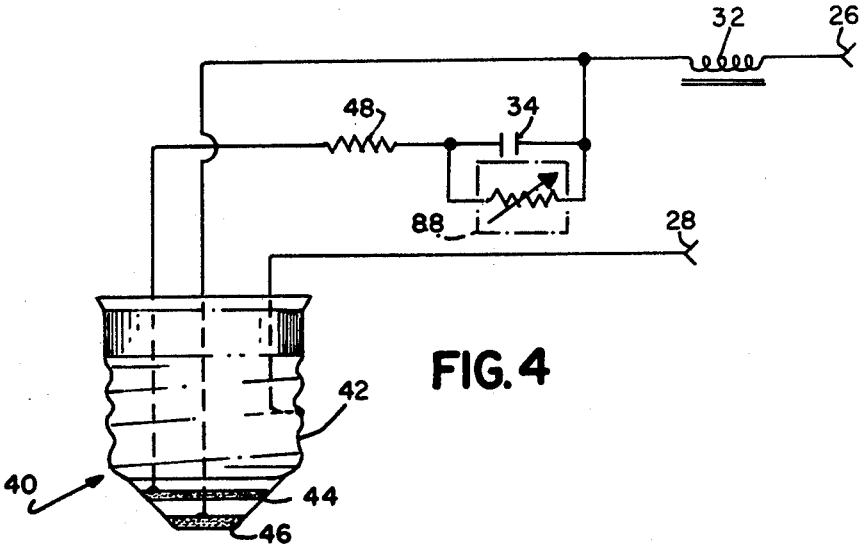
FIG. 4 is a circuit diagram of another embodiment of the dimming circuit according to the invention as connected in another manner to the three-contact type screw-in base.
Figure 5:
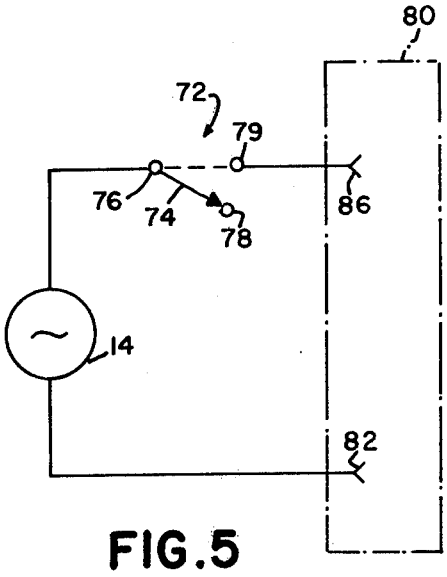
FIG. 5 is a circuit diagram of an on-off incandescent fixture showing a two-position switch.

A problem can occur, however, if the adapter of FIG. 2 is misused; more specifically, if the incandescent-to-fluorescent adapter is used with a conventional on-off type lamp with a two position switch, such as illustrated schematically in FIG. 5. In FIG. 2, when the adapter is used properly with the four-position switch of FIG. 3, energization of the first switch contact 64 causes current to flow through choke 32, lamp coil 12*a*, starter 30, and lamp coil 12*b*. Once the coils have been preheated, the starter 30 opens and the lamp ignites. Thereafter, lamp current will flow through the choke 32 and the lamp. Referring now to FIG. 5, the on-off incandescent lamp fixture comprises a two-position switch 72 having a center arm 74 connected to a common terminal 76 which in turn is connected to one side of the voltage source 14. The switch further includes an "off" position 78 and a single "on" position contact 79. Receptacle 80 of this on-off fixture includes a contact area 82 which is engageable with the outer shell 42 of FIG. 2, and a contact area 86 which is engageable with the center contact 46 of the adapter base of FIG. 2. Contact area 82 is connected to the common side of voltage source 14, while contact area 86 is connected to the "on" position contact 79 of switch 72. Accordingly, if the circuit of FIG. 2 were used with the on-off fixture of FIG. 5, the actuation of switch 72 of the "on" position 79 would cause the branch of the circuit including current reducing capacitor 34 to be energized. As a result, difficulty would be experienced in starting the lamp due to insufficient preheat current. Such a hard starting condition can eventually lead to damage of the lamp circuit. In order to overcome this problem, the wiring of the ring and center contact positions of the adapter base can be reversed, as illustrated in FIG. 4. More specifically, choke 32 is connected to center contact 46, and the circuit branch including resistor 48 and capacitor 34 is connected to the ring contact 44. With this arrangement, actuation of the two-position switch to contact 79 is operative to energize the center contact 46 of base 40 and, thus, places only choke 32 in the lamp circuit. The resulting full preheat current is sufficient for starting the lamp.

Upon making the circuit change of FIG. 4, however, consider the effect when employing the three-way fixture circuit of FIG. 3. When center arm 58 of switch 60 is moved to the first energizing position contact 64, the ring contact, and thus the capacitor branch of the adapter dimming circuit will be first in the energizing sequence. If a conventional linear bleeder resistor, such as resistor 36 in FIGS. 1 and 2, is employed, again a problem of hard starting is encountered due to insufficient preheat current when switch 60 is connected to the low current position. In order to overcome such a problem, the linear bleeder resistor is replaced with a positive-temperature-coefficient (PTC) resistor 88, as illustrated in the embodiment of FIG. 4. Initially, the lower resistance of the PTC resistor effectively shorts capacitor 34 upon energizing the circuit (contact 64). After a short period of time (e.g., 5 seconds) the resistance of the PTC device increases due to resistance heating. As a result, capacitor 34 is effectively switched back into the circuit to limit the lamp current and provide the lower light output level.

To proceed with the operation of the circuit arrangement of FIG. 4, sequencing of the center arm 58 from contact 64 to contact 66 is operative to then energize the center contact of adapter base 40 and thus place only the series choke 32 into the lamp circuit. This produces the high output level. Sequencing the center arm 58 to the contact arrangement 68 again connects the ring and center contacts of the adapter base and continues to provide high current and light output levels.

It is apparent, of course, that the hard starting problems encountered in the circuit of FIG. 2 when employed with an on-off fixture could also be overcome by replacing the resistor 36 in that circuit arrangement with a PTC resistor. The circuit arrangement of FIG. 4 is preferred, however, since when such a circuit is used with the on-off fixture, the high level of light output will be obtained in the "on" position. On the other hand, use of circuit of FIG. 2, even if modified with a PTC resistor, with the on-off fixture of FIG. 5, would result in only the low light output level being obtainable in the "on" position.

The PTC resistor 88 is selected to have a relatively low zero-power (cold) resistance, e.g., about 10 to 20 ohms at 25° C. Further, the PTC device is selected to have a switching, or Curie temperature of about 60° C. The heat up time to the switching temperature of the PTC device should be at least about 5 seconds, but it may range as high as 15 seconds. The voltage rating of the device is about 132 volts AC.

In a specific embodiment of the circuit of FIG. 4, the following component values were employed for operating a 10 inch, T9, Circline lamp 12:

| | | |
|---|---|---|
| Capacitor 34 | 4 microfarads, 200 volts. | |
| Resistor 48 | 10 ohms, 1 watt. | |
| PTC resistor 88 | Zero-power resistance at 25° C.: | 15 ohms |
| | Switching temperature: | 60° C. |
| | Heat-up time: | 5 seconds |
| | Voltage rating: | 132 volts AC |
| Choke 32 | 380 millihenrys | |

Upon energizing the high side of the circuit, namely, choke 32, via center contact 46, with a line voltage of 120 volts, the resulting lamp current was 0.671 amps, the resulting lamp operating voltage was 63.5 volts, the total system power was 47.6 watts, and the relative light output was 1. Upon energizing the low side of the circuit, namely, the capacitor branch via ring contact 44, with the same line voltage, the lamp operating current was reduced to 0.304 amps, the lamp operating voltage was 76.5 volts, the total system power was reduced to 21.3 watts, and the relative light output was 0.54. Further, in this low current position, the voltage drop across resistor 48 was three volts, the capacitor voltage was 173 volts, and the wattage of resistor 48 was 0.92 watts.

Although the invention has been described with respect to specific embodiments, it will be appreciated that modifications and changes may be made by those skilled in the art without departing from the true spirit and scope of the invention.

We claim:

1. A multiple level dimming circuit for use with a fluorescent lamp operated from a voltage supply source comprising, in combination:

inductive ballast means having a first terminal adapted to be selectively connected to said supply source and a second terminal adapted to be connected to said fluorescent lamp;

a third terminal adapted to be selectively connected to said supply source;

means including a discharge resistor and a capacitor ballast means series connected in that order between said third terminal and said first terminal;

bleeder resistance means connected across said capacitor ballast means; and said voltage supply source including a single-pole multiple-throw switch having a common terminal connected to one side of said supply source and at least first and second position contacts and a third position contact means, said first and third terminals being connectable to said first and second position contacts, respectively, and said third position contact means being connected to both said first and second position contacts.

2. The circuit of claim 1 wherein said bleeder resistance means comprises a positive-temperature-coefficient (PTC) resistor.

3. The circuit of claim 2 wherein said PTC resistor has a zero power resistance at 25° C. of about 10 to 20 ohms, a switching temperature of about 60° C., and a heat-up time to switching of at least about 5 seconds.

4. The circuit of claim 1 wherein said inductive ballast means is a choke.

5. The circuit of claim 4 wherein said fluorescent lamp is a preheat type, and further including a starter adapted to be connected across said lamp.

6. The circuit of claim 1 wherein said voltage supply source comprises an incandescent lamp fixture including said switch and having a receptacle, said first and second position contacts are connected to respective contact areas of said receptacle, said dimming circuit and said lamp are included in an incandescent-to-fluorescent adapter having a base for mating with said receptacle, said first and third terminals are respective contact areas of said base, said lamp is a preheat type having first and second filament coils, said inductive ballast means is a series choke and the second terminal thereof is connected to the first coil of said lamp; and wherein said circuit further includes a starter connected across said first and second lamp coils, and a fourth terminal comprising a respective contact area of said base connectable to the other side of said supply source by means of a respective contact area of the receptacle of said incandescent lamp fixture, said second lamp coil being connected to said fourth terminal, and the respective contact areas of said base and receptacle being electrically interconnected by engaging said base into said receptacle.

7. The circuit of claim 6 wherein said switch further includes an "off" position, and a center arm connected to said common terminal and moveable in a sequence from said "off" position to said first position contact to said second position contact to said third position contact means, the designation of said switch contact positions being determined by the base contact areas selected to be connected as said first and third terminals.

8. The circuit of claim 7 wherein said base is a three-contact base comprising an outer screw shell as said fourth terminal, a ring contact as said first terminal, and a center contact as said third terminal.

9. The circuit of claim 6 wherein said switch further includes an "off" position, and a center arm connected to said common terminal and moveable in a sequence from said "off" position to said second position contact to said first position contact to said third position contact means, the designation of said switch contact positions being determined by the base contact areas selected to be connected as said first and third terminals, and said bleeder resistance means comprises a positive-temperature-coefficient (PTC) resistor.

10. The circuit of claim 9 wherein said PTC resistor has a zero power resistance at 25° C. of about 10 to 20 ohms, a switching temperature of about 60° C., and a heat-up time to switching of at least about 5 seconds.

11. The circuit of claim 10 wherein said base is a three-contact base comprising an outer screw shell as said fourth terminal, a ring contact as said third terminal, and a center contact as said first terminal.

* * * * *